United States Patent [19]

Gliha et al.

[11] Patent Number: 4,707,048

[45] Date of Patent: Nov. 17, 1987

[54] ELECTRICAL CONNECTOR HAVING MEANS FOR PROTECTING TERMINALS FROM TRANSIENT VOLTAGES

[75] Inventors: Edward R. Gliha, Bainbridge; Leonard A. Krantz, Jr., Sidney, both of N.Y.

[73] Assignee: Amphenol Corporation, Wallingford, Conn.

[21] Appl. No.: 926,929

[22] Filed: Nov. 3, 1986

[51] Int. Cl.[4] ..... H01R 13/66

[52] U.S. Cl. ..... 439/620; 333/185

[58] Field of Search ..... 333/181, 182, 183, 184, 333/185; 339/147 R, 147 P

[56] References Cited

U.S. PATENT DOCUMENTS 4,376,922 3/1983 Muzslay ..... 333/183

4,572,600 2/1986 Nieman ..... 339/147 R 4,582,385 4/1986 Couper et al. ..... 339/147 R 4,600,262 7/1986 Nieman et al. ..... 339/147 R

*Primary Examiner*—Gil Weidenfeld

*Assistant Examiner*—Gary F. Paumen

*Attorney, Agent, or Firm*—Bacon & Thomas

[57] ABSTRACT

An electrical connector having means for protecting its terminals from transient voltages includes a selectively plated cavity endwall in a substrate being laterally offset from its respective terminal receiving passage, a silicon diode being mounted in the cavity and connected to a conductive spring, and ground paths completing a conductive circuit between the terminal, the endwall and the connector shell, the spring completing an electrical ground path through the diode for overvoltages to be diverted from the terminal to the shell ground.

6 Claims, 3 Drawing Figures

FIG. 1
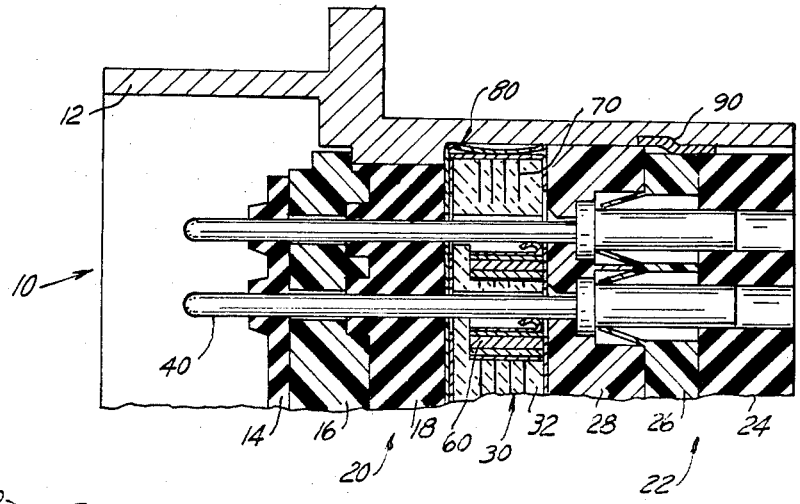
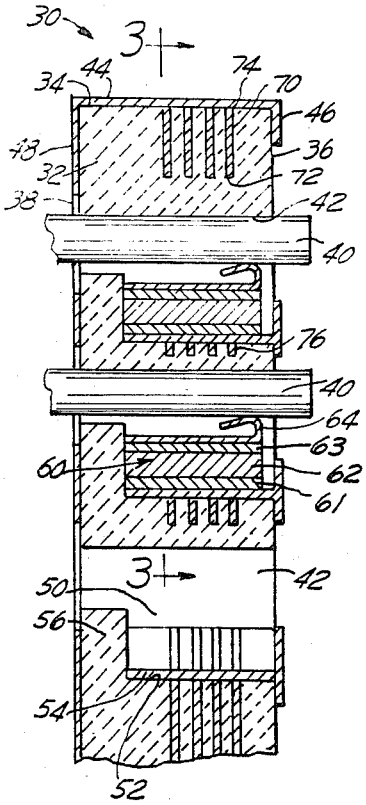
FIG. 2
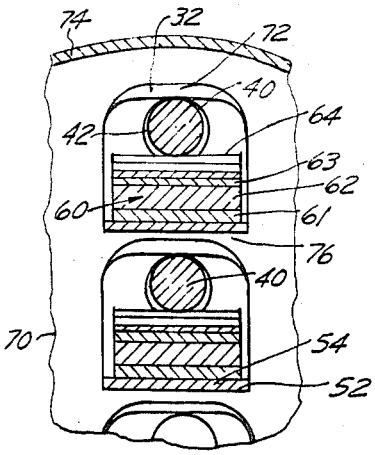
FIG. 3

ELECTRICAL CONNECTOR HAVING MEANS FOR PROTECTING TERMINALS FROM TRANSIENT VOLTAGES

This invention relates to an electrical connector having means for protecting its terminals from transient voltages.

Connector assemblies include a metal shell carrying an insulator having an array of passages extending therethrough, a terminal in each respective passage, and in many applications an arrangement for filtering, shielding, grounding, or otherwise controlling the signal passing through the terminal. Since space is almost always at a premium increasing the number of signal carrying terminals a connector can carry reduce the cost of the connector. The passage array may be densified by making the passages and terminals cylindrical in cross-section whereby close toleranced fitment between each is achieved, spacing between adjacent passages is reduced, and cylindrical cross-sectioned circuit components (e.g., a tubular capacitor) may be disposed about the terminal and within the passage. Desirably any circuit protecting component would be recessed to protect it from installation environments.

Unless electrically protected solid state circuitry is vulnerable to transient pulses such as switching transients on power lines, lightening, electromagnetic pulses (EMP) and electrostatic discharges (ESD). A surge of just a few volts can wipe out microprocessors (e.g., printed circuits). Accordingly these signals must not be allowed to pass through the connector and reach the device. One approach is to ground these voltages to a common shell ground.

A silicon diode is a planar chip of silicon disposed between two electrodes (i.e., epitaxial) and functions as a voltage divider by passing voltages having a predetermined value but diverting voltages exceeding the predetermined. The chip is not formed but "grown" and when treated with special non-silicon impurities will respond rapidly (i.e., "turn-on" in $10^{-9}$ seconds) to divert voltage pulses having fast rise times and amplitudes exceeding the predetermined value. However manufacturers have not been able to grow the chip into a cylindrical shape and the non-cylindrical nature of the diode has restricted its use in applications requiring the diode to mount against or about cylindrical surfaces, such as the connector terminal.

A connector shell would desirably carry a plurality of terminals and have an arrangement for protecting its circuits by being electrically connected to a common shell ground (such as through a recessed diode).

This invention contemplates an electrical connector assembly comprising a conductive shell carrying therewithin a dielectric substrate having an array of passages extending therethrough, a terminal disposed within each passage, and grounding means for electrically grounding the terminal to the shell.

In accordance with this invention, the connector assembly is characterized in that the passage terminates in a laterally offset cavity wherein one endwall thereof is conductively plated, and voltage limiting means in electrical circuit relation to with the grounding means and the terminal for limiting voltages received by the terminal to a predetermined value, the voltage limiting means comprising a circuit component in electrical circuit relation to the terminal and the endwall.

The circuit component is removably disposed within the offset cavity and has a pair of electrodes separated by a chip consisting of silicon and conductive bias means connected to one electrode for resiliently contacting the terminal and biasing the other electrode against the plated endwall.

The grounding means comprises the substrate having a conductive path electrically connecting the shell to the plated endwall thereby completing an electrical ground path between the shell, the terminal, and the circuit component. The substrate comprises a planar cylindrical selectively metallized dielectric disc, the plating including the circumference and the top and bottom surfaces of the disc contiguous to the circumference, and the top surface of the disc adjacent to the cavity and contiguous to the plated endwall. A plurality of parallel plates are embedded in the dielectric such that one end is spaced from the passage and the other end terminates on the circumference plating.

A metal bottle-cap shaped ground spring including a slitted resilient periphery is configured to receive the disc and be interposed between the plated circumference and the inner wall of the shell whereby to complete a conductive ground path therebetween.

A connector assembly so described will permit the terminal to be removed; protect the diode from the users environment; and permit the diode to be attached to the substrate and fully tested prior to assembly of the connector assembly. Previous designs have attempted to attach the chip to the terminal exposing it to an unprotected environment where its performance can be affected. Without an easy way to test a diode prior to its assembly into the connector or replace a diode once assembled, the user may not receive the circuit protection he specifies.

The invention will now be described, by way of example, with reference to the following drawings in which:

FIG. 1 is a side view in partial section of an electrical connector assembly.

FIG. 2 is an enlarged view in section of a substrate shown in the connector of FIG. 1.

FIG. 3 is an top view taken along lines III—III of FIG. 2.

Referring now to the drawings, FIG. 1 shows a connector assembly comprising a conductive cylindrical shell 12 carrying therewithin a forward insert assembly 20, a rearward insert assembly 22, and a grounding assembly 30, 80 sandwiched between the insert assemblies, each assembly being cylindrical and having a like array of passages extending therethrough with the passage in each assembly receiving a conductive signal carrying terminal 40.

The forward insert assembly 20 includes a dielectric insert 16, an interfacial seal 14 to seal the terminal passageways from moisture penetration, and a rearward grommet 18 to seal the forward end of the shell. The rearward insert assembly 22 includes a pair of dielectric inserts 26, 28, and a rearward grommet 24 to seal, respectively, the terminal passageways and the rearward end portion of the shell from moisture penetration. A dielectric band 90 is employed to interference fit the rearward insert assembly 22 into the shell.

The dielectric inserts insulate the terminals from one another and from the shell with the forwardmost insert 16 further providing a rigid support for mounting the interfacial seal 14 and the rearwardmost set of inserts 26, 28 further providing a rigid support for locating and retaining the terminals. The terminal retention arrangement includes resilient tines which converge into the respective passages extending through the inserts 26, 28, the tines captivating the terminal and allowing rear insertion and rear removal of the terminals from the shell.

The grounding assembly comprises a generally planar dielectric substrate 30 being formed into a cylindrical disc and interference fit into a metallic bottle-cap shaped grounding spring 80. The substrate and spring have a plurality of respective passages extending therethrough for passing the respective plurality of terminals 40.

While shown best in FIG. 2, the substrate has an array of passages 42 extending perpendicularly between flat top and bottom surfaces 36, 38 thereof and a laterally offset cavity 50 being disposed in each passage 42. Voltage limiting means for limiting transient external voltages received by a terminal to a predetermined value comprise a circuit component 60 being carried in each cavity.

The substrate is selectively metallized in that its circumference is conductively plated, one endwall of each cavity is conductively plated, and the top and bottom surfaces of the substrate are conductively selectively plated at 46, 48 such that plating completes a conductive path that extends across each surface to interconnect with the plating 44 on the circumference 34, the paths on each being spaced from the passage 42 but the plating 46 on the top surface 36 being in contact with the plating 54 of each endwall 52. A plurality of apertured grounding plates 70 are embedded in the substrate and at a portion 76 thereof electrically interconnect the plating 54 of the endwalls and the circuit component 60 to the grounding spring 80.

FIG. 2 shows the substrate 30 and the voltage limiting arrangement 60 for limiting transient external voltages received by a terminal to a predetermined value. In particular, the substrate is selectively plated (i.e., metallized) including plating 44 on the outer periphery 34, plating 46, 48 on the top and bottom surfaces 36, 38 of the disc contiguous to the periphery and on the top surface 36 of the disc adjacent to the cavity 50 and contiguous to the plating 54 on the offset endwall 52.

The grounding means further comprises the plurality of parallel apertured grounding plates 70, each plate being embedded in the dielectric such that its outer end 74 is terminated to the plating 44 around the disc periphery, and each plate aperture encircling each passage 42 so as to be spaced from the unplated walls thereof but terminated to the plating 54 on the endwall 52 offset therefrom.

The circuit component 60 is a silicon diode removably disposed within each cavity and comprises a silicon chip 62 sandwiched between a pair of electrodes 61, 63, and a metal leaf spring 64 connected to one electrode 63 for engaging the terminal 40 in that passage and biasing the other electrode 61 against the plating 54 on the endwall 52, the spring 64 completing an electrical circuit path between the terminal 40 and the electrode 63. The other electrode 61 completes an electrical connection to ground through the plating 54, the plates 70 and the plating 46 on the top surface, each terminating electrically to the plating 44 around the periphery 34, and through the grounding spring 80 to the shell.

The diode preferably would be an "avalanch type" (i.e., a special case of a Zener diode) which does not form part of the circuit until presented with a voltage pulse exceeding a predetermined amplitude whereupon the diode "turns-on" and holds the voltage passing through the terminal to the predetermined voltage level and shunts the over-voltage to ground (the shell). These diodes are designed to "turn-on" under extremely fast rise time voltage pulses (e.g., pulse widths of $10^{-9}$ seconds).

FIG. 3 shows the substrate, the unmetallized passages 42 extending therethrough, the terminal 40 passing through the passage, the laterally offset cavity 50 and its plated endwall, and the silicon diode 60 disposed in the cavity.

The cavity is configured to accept the diode and the leaf spring. In some applications to assure that electrical continuity would not be compromised by loose fitment or oxide buildup solder could be applied to the electrode 61 and the plating 54. The terminal passes through the cavity making electrical and mechanical contact with the leaf spring 64 provided on the diode. The passage extending through the substrate which receives the remainder of the terminal would not be metallized.

Having described the invention what is claimed is:

1. An electrical connector assembly comprising a conductive shell carrying therewithin a dielectric substrate having an array of passages extending therethrough, a terminal disposed within each passage, the grounding means for electrically grounding the terminal to the shell, the connector assembly is characterized in that each passage terminates in a laterally offset cavity wherein one endwall thereof is conductively plated, and voltage limiting means seated in said cavity and in electrical circuit relation to the grounding means and the terminal for limiting voltages received by the terminal to a predetermined value, the voltage limiting means comprising a circuit component in electrical circuit relation to the terminal and the endwall, each said terminal having its own distinct voltage limiting means.

2. The electrical connector assembly as recited in claim 1 wherein the circuit component is removably disposed within the offset cavity and comprises a pair of electrodes separated by a chip consisting of silicon, and conductive bias means connected to one electrode for resiliently contacting the terminal and biasing the other electrode against the plated endwall.

3. The electrical connector assembly as recited in claim 2 wherein the grounding means comprises the substrate having a conductive path electrically connecting the shell to the plated endwall thereby completing an electrical ground path between the shell, the terminal, and the circuit component.

4. The electrical connector assembly as recited in claim 2 wherein the substrate comprises a selectively metallized planar dielectric disc, the plating including the outer periphery and the top and bottom surfaces of the disc contiguous to the periphery, and the top surface of the disc adjacent to the cavity and contiguous to the plated endwall.

5. The electrical connector assembly as recited in claim 4 wherein the grounding means comprises a plurality of apertured parallel plates, each plate being embedded in the dielectric such that its outer periphery is terminated to the plating around the disc, and each plate aperture encircling one passage so as to be spaced from the unplated walls and terminated to the plated endwall offset therefrom.

6. The electrical connector assembly as recited in claim 5 wherein the grounding means comprises a metal bottle cap shaped grounding spring including a slitted resilient periphery, said spring being configured to receive the disc and engage the inner wall of the shell whereby to complete conductive ground path between the shell and the terminal.

* * * * *